US005944114A

United States Patent [19]

Farley

[11] Patent Number: 5,944,114

[45] Date of Patent: Aug. 31, 1999

[54] DEVICES FOR CONSTRAINING WILDFIRES

[76] Inventor: Brent L. Farley, 1808 Rambling Ridge La. Apt. No. 301, Baltimore, Md. 21209

[21] Appl. No.: 09/013,273

[22] Filed: Jan. 26, 1998

Related U.S. Application Data

[60] Provisional application No. 60/036,425, Jan. 27, 1997.

[51] Int. Cl.[6] ..... A62C 8/00

[52] U.S. Cl. ..... 169/48; 169/51; 256/24; 256/26; 256/31; 256/29

[58] Field of Search ..... 256/24, 26, 31, 256/2 A; 169/48–51

[56] References Cited

U.S. PATENT DOCUMENTS

| | | | |
|---|---|---|---|
| 150,308 | 4/1874 | Elliot | 256/31 |
| 392,347 | 11/1888 | Krause | 256/31 |
| 2,449,311 | 9/1948 | Murphy | 169/50 |
| 3,797,787 | 3/1974 | Wantanabe | 256/24 |
| 4,311,199 | 1/1982 | Elias | 169/48 |
| 4,958,806 | 9/1990 | Sato et al. | 256/12.5 |
| 5,505,265 | 4/1996 | O'Neil | 169/48 |

FOREIGN PATENT DOCUMENTS

| | | | |
|---|---|---|---|
| 2615109 | 11/1988 | France | 169/48 |
| 2684008 | 5/1993 | France | 169/48 |
| 1298458 | 3/1970 | United Kingdom | 169/48 |

*Primary Examiner*—Kevin Weldon
*Attorney, Agent, or Firm*—Richard L. Huff

[57] ABSTRACT

Devices for constraining wildfires are disclosed. The first device is a free-standing hollow structure which contains at least one lower intake duct, a vertical duct, and an upper outlet duct. This device contains curved chambers which may have baffles. This device also provides an open container for the delivery of water to the fire in the form of steam. A second device is a free-standing structure which is anchored to the ground by lines attached to spikes and supporting legs. The upper portion of the device is curved toward the fire so as to direct the fire back upon itself. There is an arcuate baffle at approximately the midpoint of the device which serves to break up the heat wave. A third device is similar to the second device in design, but is made of folding sections for ease of storage and transportation. A fourth device comprises a fire-resistant sheet which may be draped over trees or structures or may be put on the ground to form a barrier to the fire. A plurality of these devices may be aligned at the perimeter of a fire to establish a barrier to constrain the fire or may be placed around real or personal property to protect that property. A fifth device is a fire-resistant sheet which may be stored as rolls and joined with other sheets to form a barrier. One type of device may be used alone, or as many as all five types may be used in combination.

3 Claims, 15 Drawing Sheets

DEVICES FOR CONSTRAINING WILDFIRES

BACKGROUND OF THE INVENTION

This application claims the benefit of U.S. Provisional Application No. 60/036,425 filed Jan. 27, 1997.

1. Field of the Invention

This invention concerns the containment of wildfires by the use of physical barriers.

2. Description of the Related Art

As residential areas expand into relatively untouched wildlands, people living in these communities are increasingly threatened by forest fires. As population in these areas increases, so does the likelihood of fire as more than four out of every five forest fires are started by people. Protecting structures in the wildlands from fire poses special problems, and can stretch firefighting resources to the limit. If heavy rains follow a fire, other natural disasters can occur, including landslides, mudflows, and floods since once ground cover has been burned away, little is left to hold soil in place on steep slopes and hillsides. A major wildland fire can leave a large amount of scorched and barren land. These areas may not return to prefire conditions for decades. If the wildland fire destroys the ground cover, erosion becomes one of several potential problems. If the spread of wildfires can be kept to a minimum, landowners continue to invest in forestry, knowing that their lands have effective and reasonable protection from fire; the total cost and loss resulting from wildfire in terms of suppression costs and damage to timber, forest value, and structures is held to minimum levels; and protection is provided for other forest values, such as watersheds, wildlife, recreation, aesthetics, and soil.

At the present time, wildfires are suppressed by dumping large quantities of fire retardants from aircraft, the use of backfires, and the creation of open areas with the intent of depriving the fire of fuel. These methods are costly in terms of expendable materials and manpower. Also, these methods have proven to be only partially successful.

Examples of the inability of people to suppress forest fires is seen from the facts that in 1988, the greater Yellowstone National Park fire destroyed or damaged private structures, including 17 mobile homes, 4 dwellings, a general store, 12 garages and outbuildings, 19 cabins, and several storage structures, and burned 1,210,730 acres of wildland; in 1990, hot, dry conditions in California contributed to brush fires in Santa Barbara County that destroyed more than 600 buildings, caused over $200 million of damage and killed one person; and in 1991, wildland fires in Oakland California, caused 6 deaths and 148 injuries; destroyed over 3,000 structures; left over 5,000 people homeless and resulted in $1.5 billion in damages. These isolated instances point out the need for an effective method of constraining wildfires. The present invention is directed to devices which solve the above problems.

SUMMARY OF THE INVENTION

In the method of constraining wildfires according to the present invention, a proposed perimeter is established. This proposed perimeter may be across the path of the wildfire or around buildings and personal property. The devices of the invention are transported by truck to an area near the predetermined perimeter, unloaded, and carried by helicopter to the predetermined perimeter, where the devices are set in place. Once in place, the devices inhibit the spread of substantially all of the fire beyond the perimeter. Any fire going beyond the perimeter can be easily extinguished by conventional means.

One device according to the present invention is 30–50 feet in height. It is intended to stand on solid ground and be in side-by-side abutment with other similar devices to form an impenetrable barrier to the fire. The device is made of fire-resistant material, such as ceramic, thermosetting resins, or sheet metal. This device contains at least one opening facing the fire which allows entry of heat and fire into the device, which is hollow. The heat is transported through at least one horizontal duct to a vertical duct at the back of the device. The heat is then transported upwardly by natural forces and is directed out of an opening at the top of the device in a direction toward the fire. This has the tendency to interrupt the flow of the heat waves at the level of the top opening. This device also contains at least one curved chamber which allows for the entry of heat and fire. Due to the curvature of the surfaces of these chambers and to the presence of baffles which may be present, the direction of the heat waves is altered, the force of the heat waves is reduced, and the heat is discharged toward the fire. Provision is made for the introduction of water into a container near the back of the device. This water is fed to an open container near the ground near the front of the device, where it turns to steam, and has the tendency of extinguishing the fire.

A second device of the present invention is also a tall device made of fire resistant material, such as ceramic, thermosetting resin, or sheet metal. The device has downward protrusions which have the tendency to penetrate solid ground when dropped from a helicopter and ensure the stability of the device. The device is also equipped with attachments for supporting lines on the front and back surfaces. These attachments hold support lines which are anchored to supporting spikes in the ground. To aid in the support of this device, each device has supporting legs extending from the front and rear surfaces of the device, the bottom of these supporting legs may be equipped with downward protrusions to help anchor the legs into the ground. The devices are made of a solid body which slants toward the fire at the top of the device so as to turn the fire back upon itself. There is also an arcuate baffle on the front surface which serves to disrupt the flow of the heat waves.

A third device of the present invention is also a tall device intended to stand upon solid ground. It is made of fire resistant material, such as ceramic, thermosetting resin, or sheet metal. This device contains a plurality of hingedly attached horizontal sections which allow ease in storage and transportation. The lower section contains outwardly foldable supports attached to both the front and rear surfaces of the device and supply stability to the device. This device is substantially vertical in structure, with its top section forming an upwardly and outwardly directed arcuate section. An upwardly and outwardly directed arcuate baffle is attachable about half way up the device. The top arcuate section and the baffle serve to disrupt the pattern of the heat waves and force the fire back upon itself.

A fourth device of the present invention takes the form of a large sheet of fire resistant material, such as asbestos fiber. Such materials are known, and are used by welders for protection against sparks and heat. The sheet of the present invention may be folded to such a size as to be capable of being loaded onto truck beds. When unloaded and spread out, each individual sheet is approximately 100 yards long and 20 yards wide, Each sheet has weights on one end and a tow line on the other end to allow for transport by helicopter. If the fire is a crown forest fire, the sheets may be draped on trees at the perimeter. If the fire is a brush fire, the sheets may be laid horizontally on the brush and ground. It is intended that the sheets will be laid end to end so as to establish a long barrier. In the event extremely windy conditions exist, a plurality of sheets may be laid side by side to establish a wider barrier. Any isolated fires getting beyond the barrier of this invention can be put out by conventional methods. These devices may also be laid across buildings or personal property to offer protection from wildfires.

A fifth device of this invention takes the form of a plurality of fire-resistant sheets. These sheets are made of aluminum bonded to glass cloth with a fire-resistant adhesive. The sheets are stored and transported in rolled-up form. Theses sheets, which measure approximately twenty feet by twenty feet, may be deployed in a vertical position and attached to each other to form a fence. For rocky terrain, the sheets are suspended from arches. For terrain with loose soil, the sheets are supported by being held in containers having bases which are held in the ground by spikes.

The devices of this invention may be retrieved following the fire and stored until needed again. Thus, over the long life-span of these devices, the cost is minimal.

DESCRIPTION OF THE PREFERRED EMBODIMENTS

Figure 1:
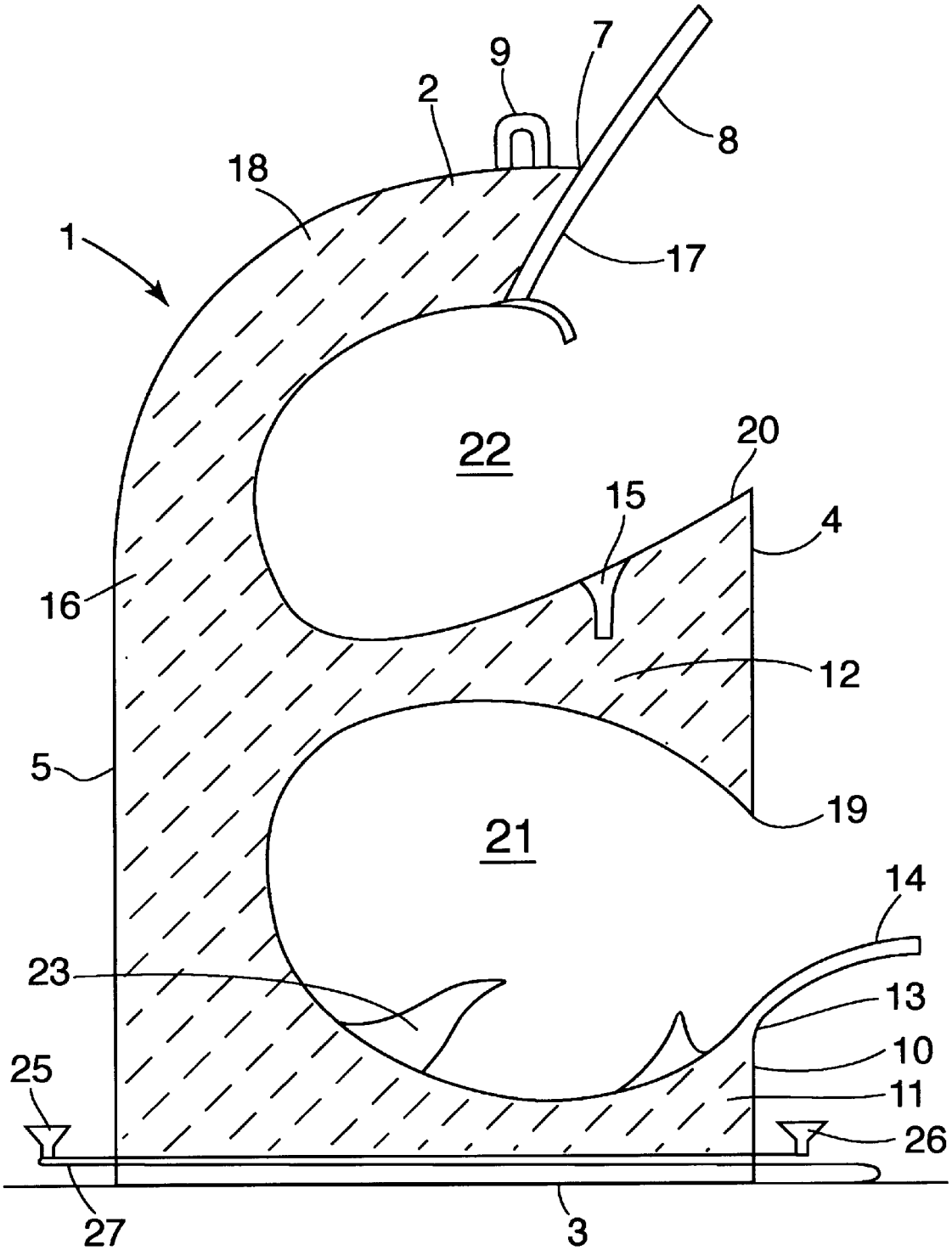
FIG. 1 is a cross-sectional view of one aspect of the first device of this invention.
Figure 2:
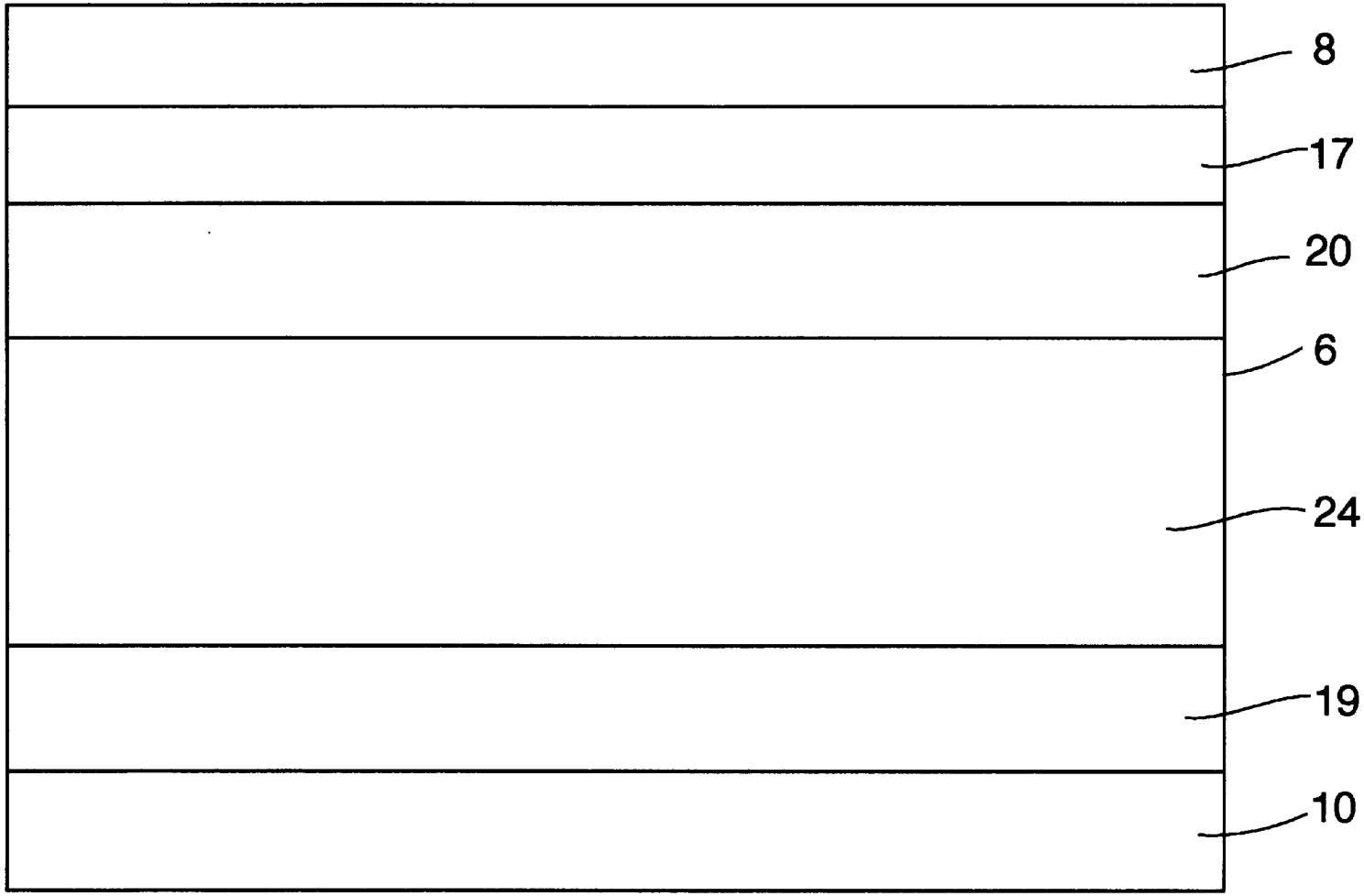
FIG. 2 is a front view of one aspect of the first device of this invention.
Figure 3:
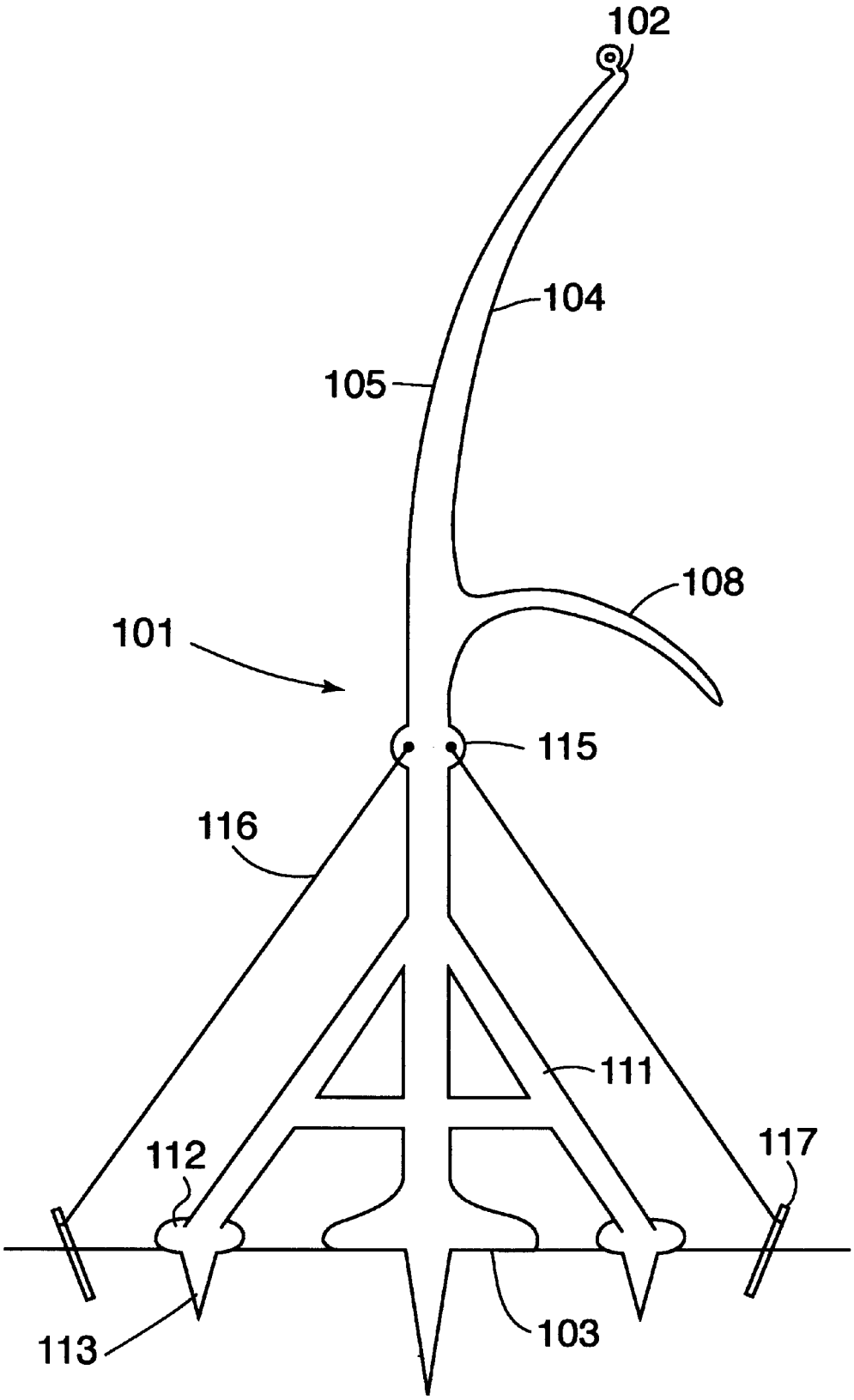
FIG. 3 is a cross-sectional view of the second device of the invention.
Figure 4:
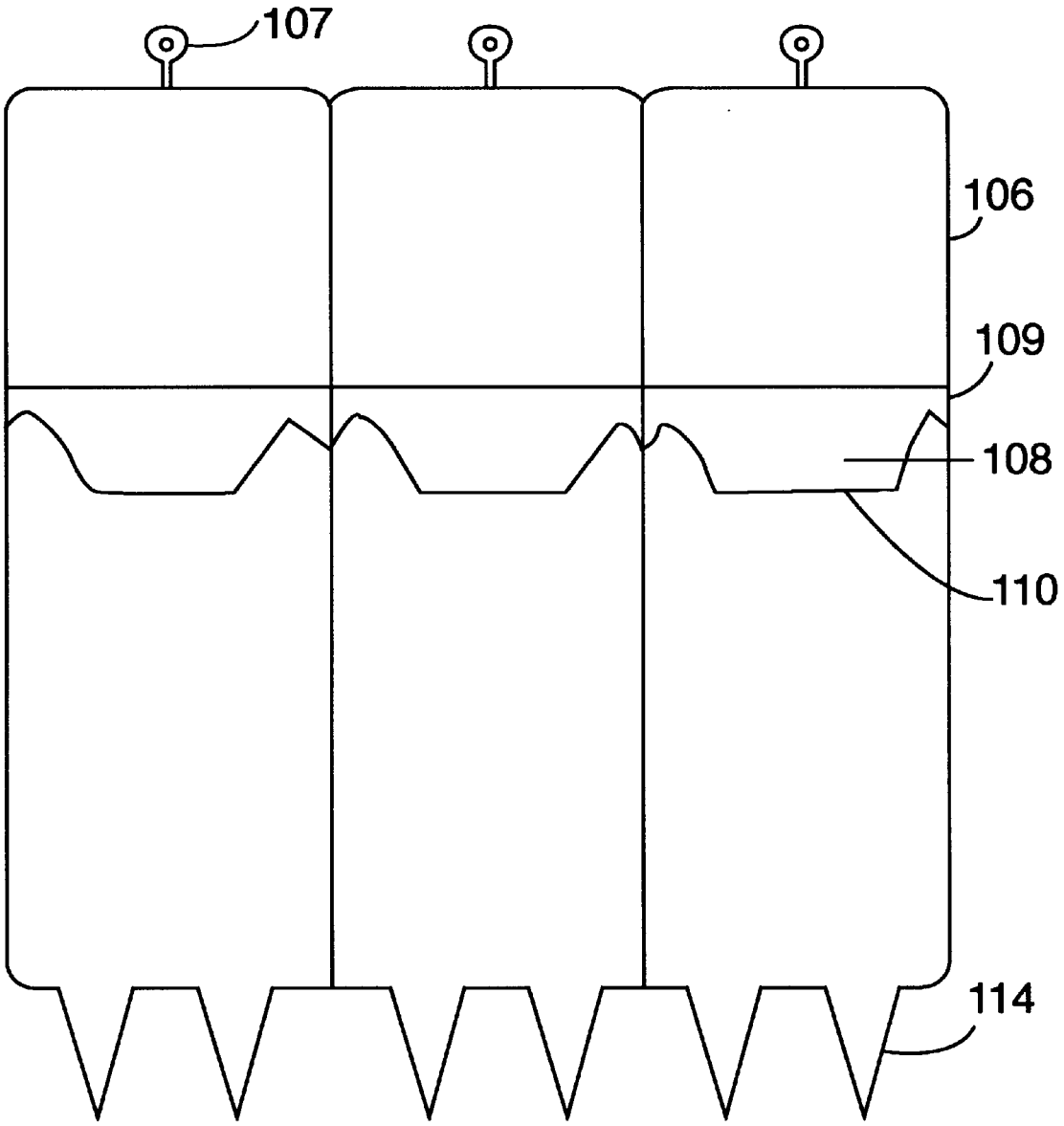
FIG. 4 is a front view of a plurality of such devices attached side by side.
Figure 5:
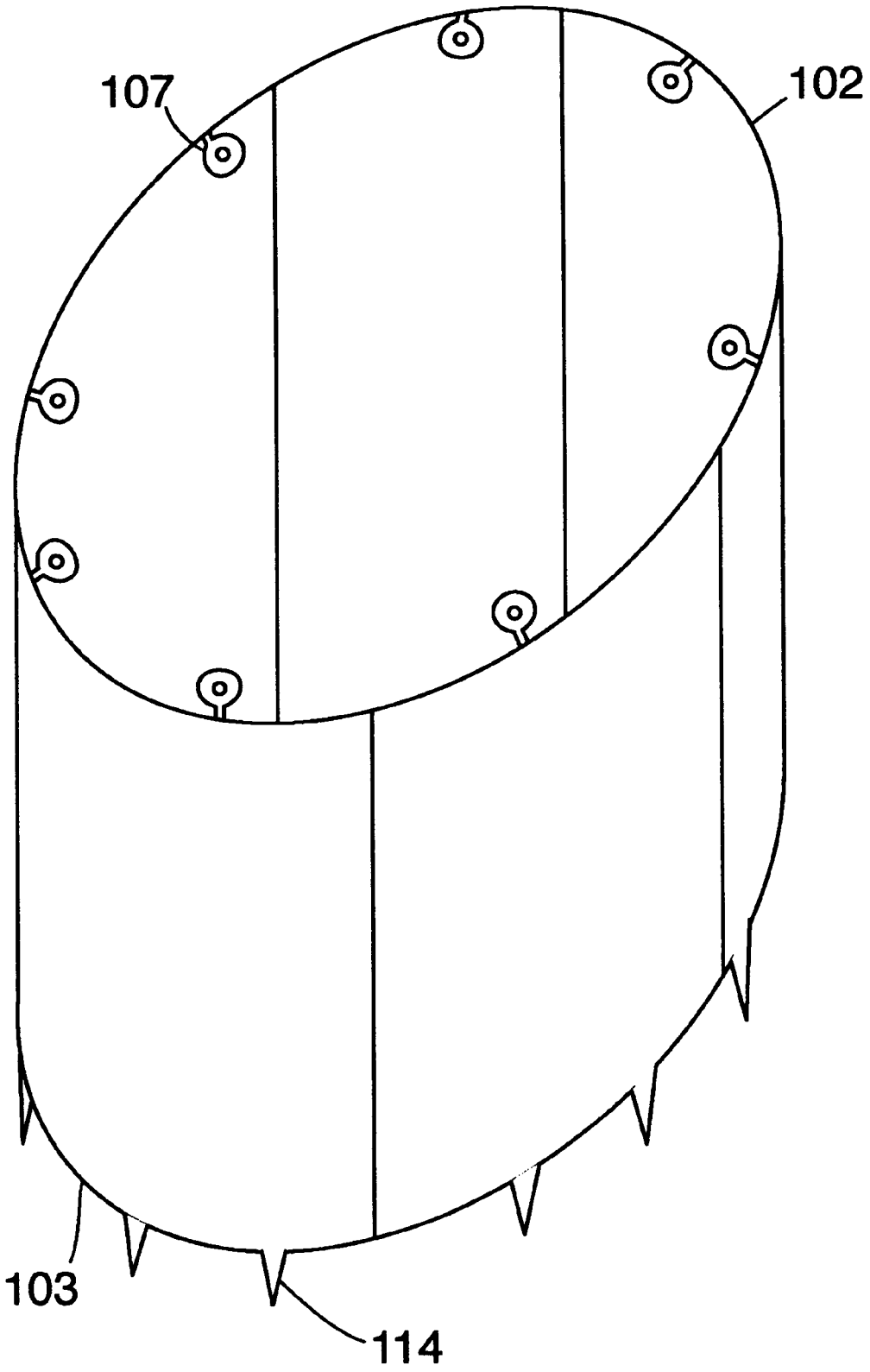
FIG. 5 is a perspective view of a plurality of such devices attached side by side so as to form an enclosure. For clarity, the legs are not shown.
Figure 6:
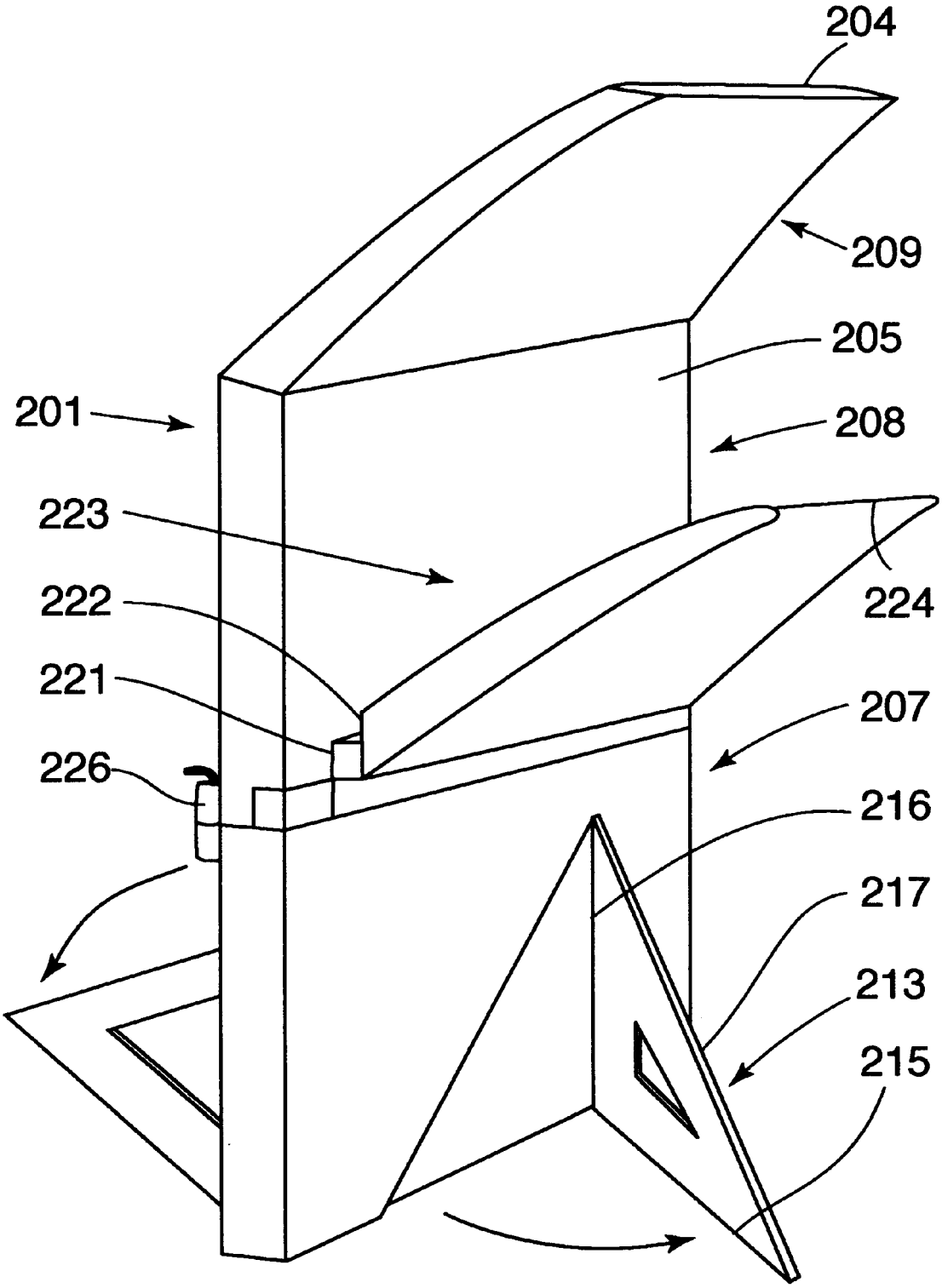
FIG. 6 is a perspective view of the third device of the present invention showing in detail how the baffle is attached.
Figure 7:
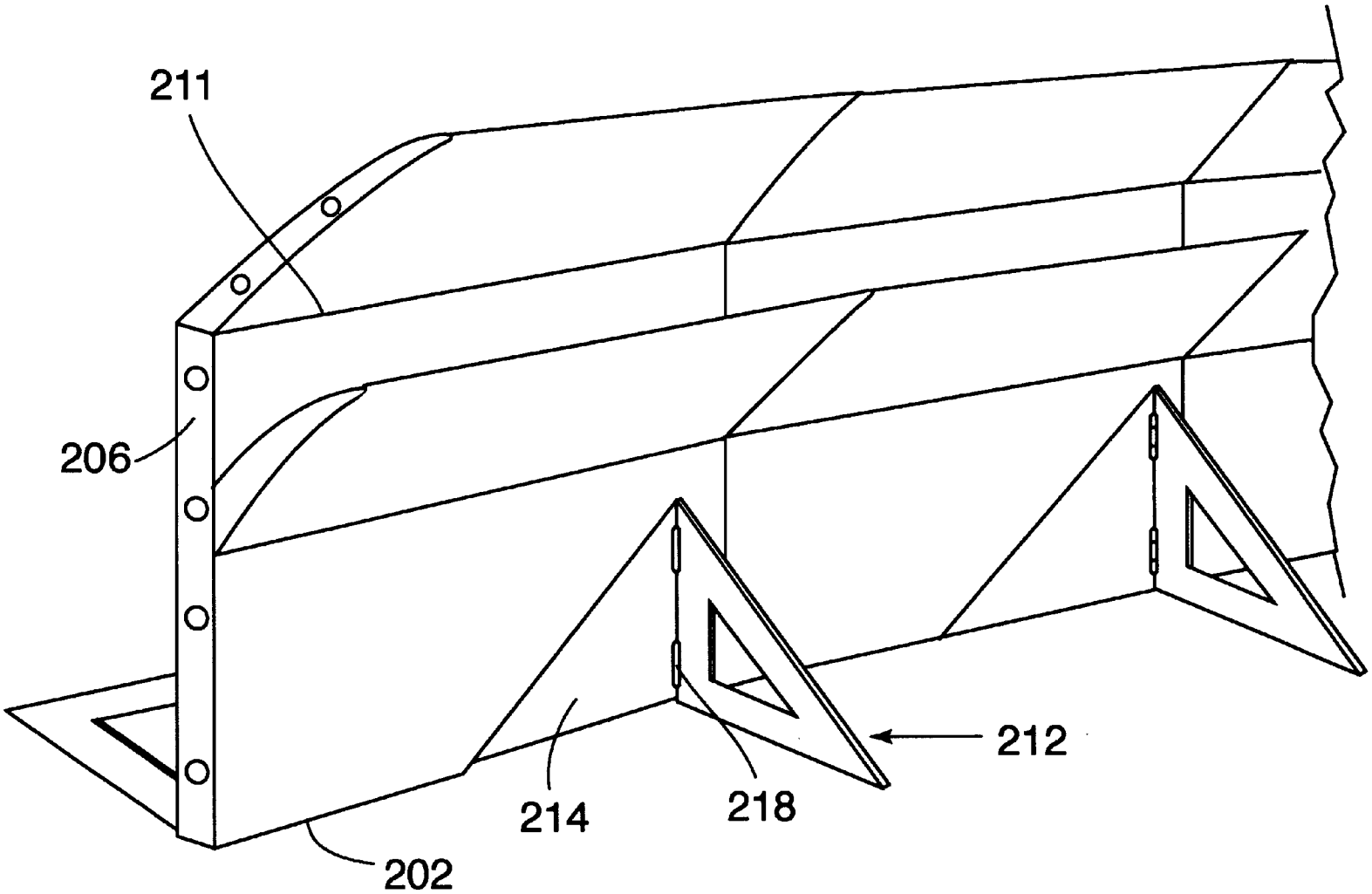
FIG. 7 is a perspective view of a plurality of such devices attached side by side.
Figure 8:
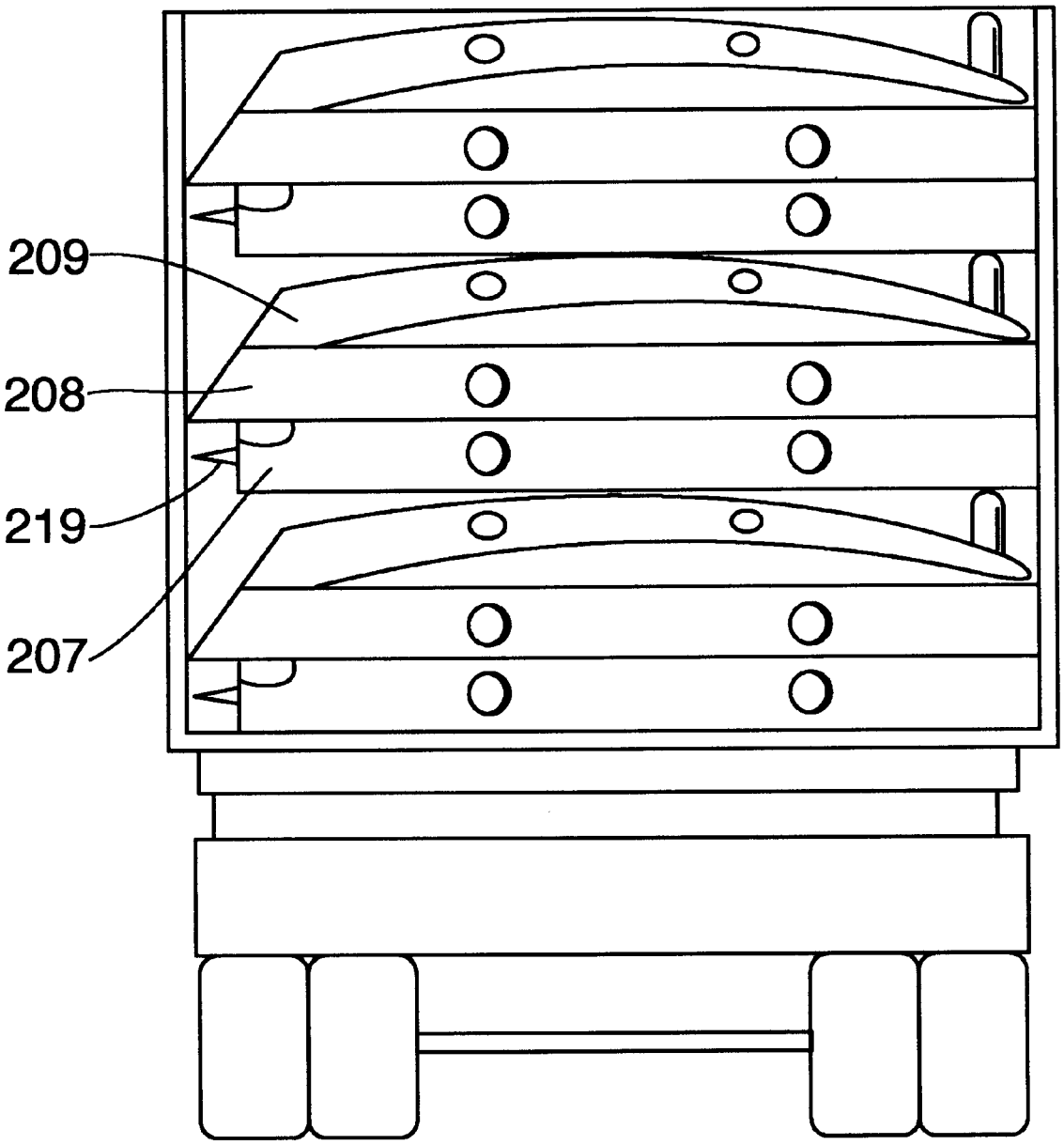
FIG. 8 is an elevational view of three such devices in a folded condition loaded on a truck.
Figure 10:
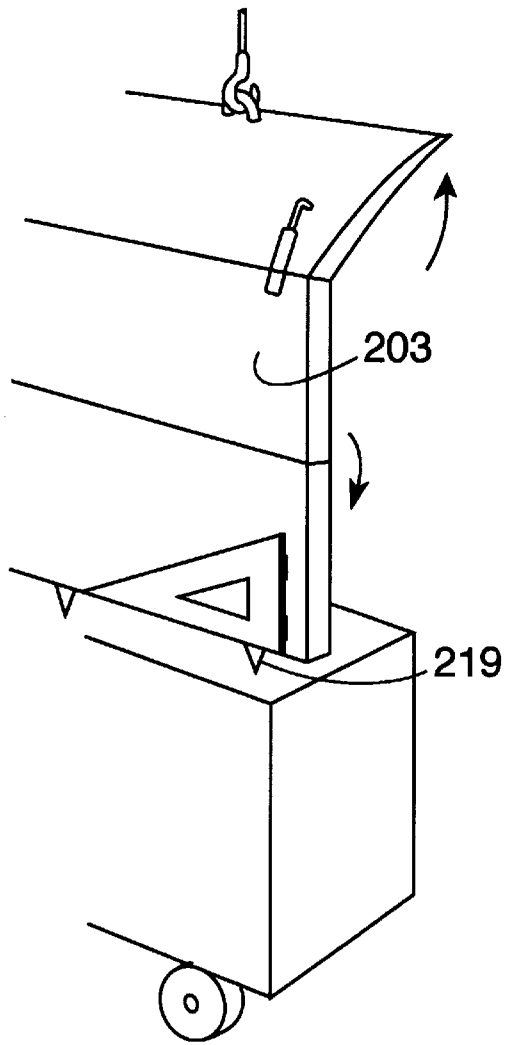
FIG. 10 is a perspective view of one such device having just been unloaded from a truck.
Figure 9:
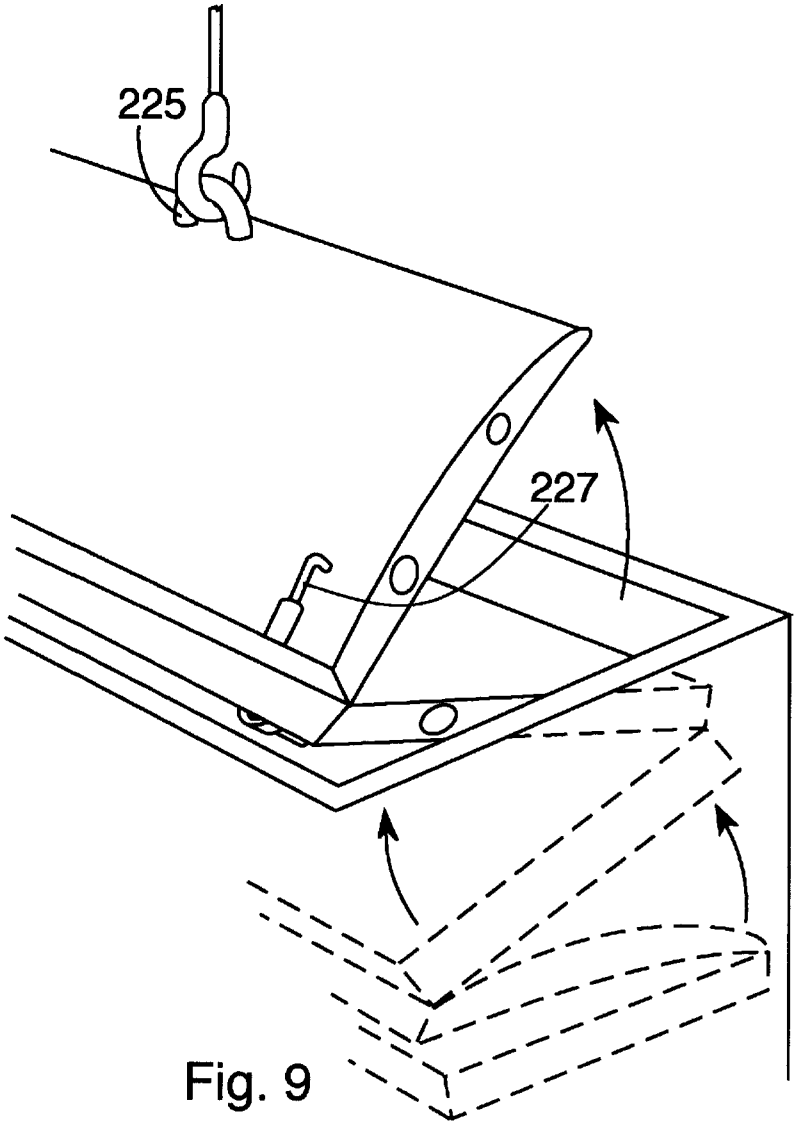
FIG. 9 is a perspective view of one such device starting to be unloaded from a truck.
Figure 13:
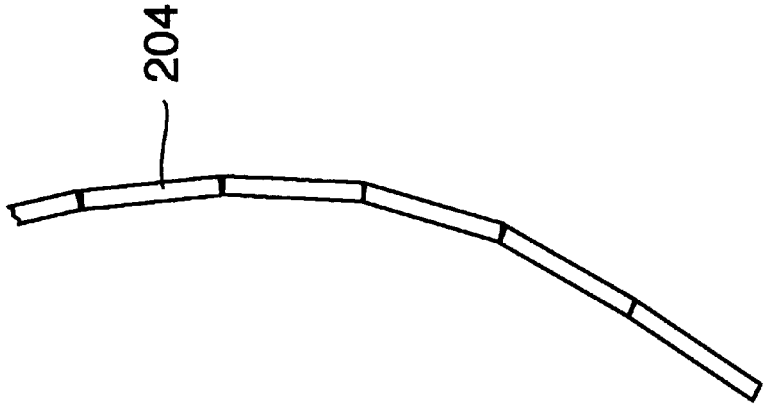
FIG. 13 is an overhead view showing a plurality of the devices abutted side by side. For clarity, the baffles and folding supports are not shown.
Figure 12:
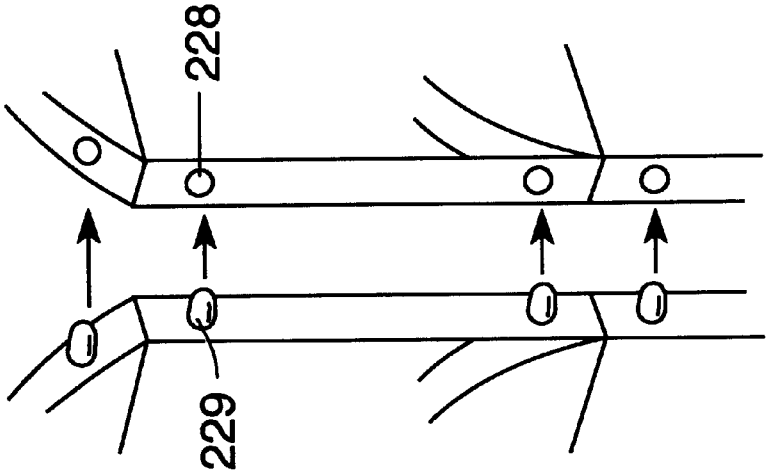
FIG. 12 is a perspective view in section showing how a plurality of such devices are lined up side by side.
Figure 11:
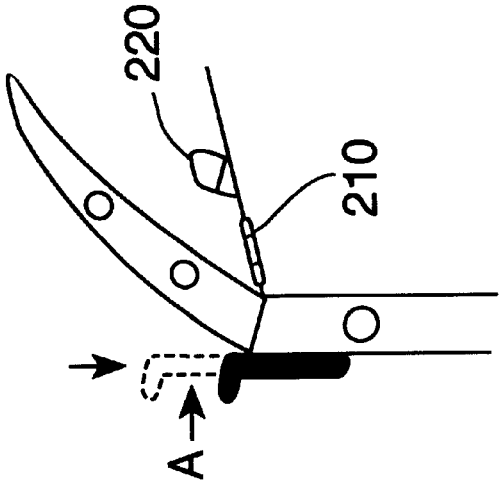
FIG. 11 is a close-up perspective view showing how the segments of the third device of this invention are secured.
Figure 14:
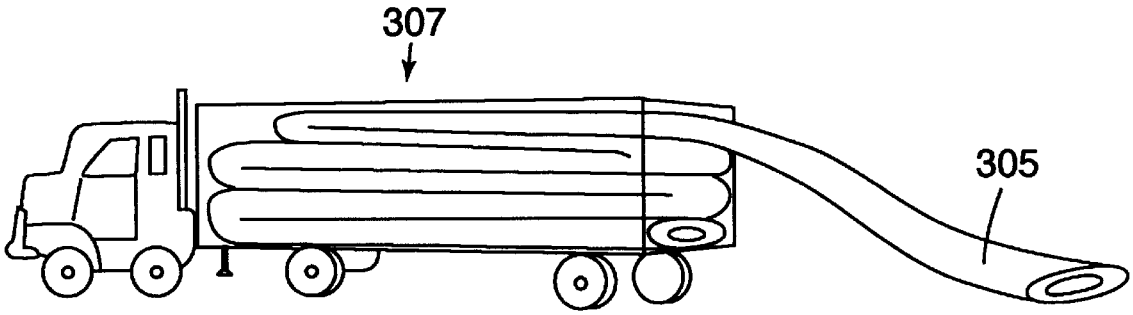
FIG. 14 is a perspective view showing the fourth device of this invention being unloaded from a truck.
Figure 15:
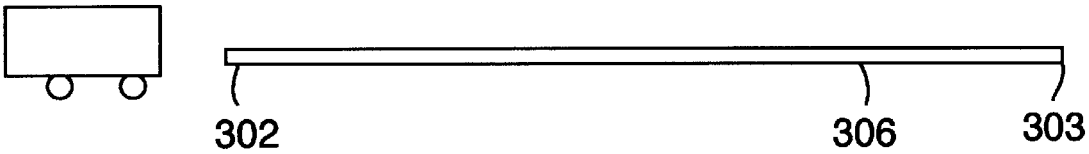
FIG. 15 is side view of the sheet of the present invention after having been offloaded from a truck.
Figure 16:
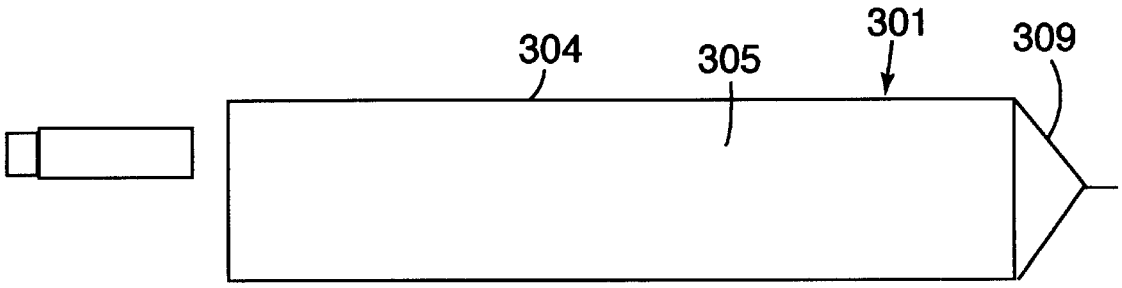
FIG. 16 is a top view of the fourth device of this invention after having been offloaded from a truck and unfolded.
Figure 17:
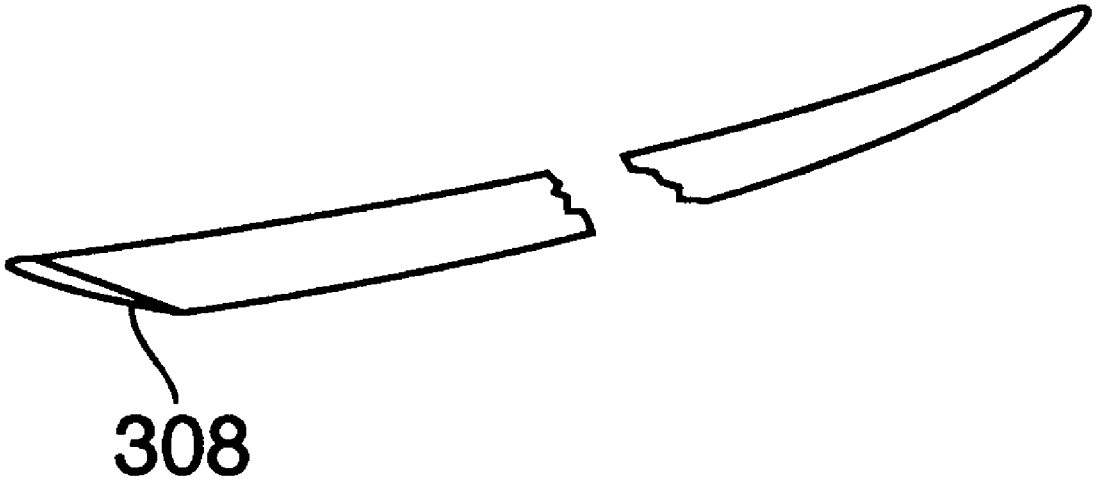
FIG. 17 is a perspective view of the fourth device of the present invention being transported by helicopter (not shown).
Figure 18:
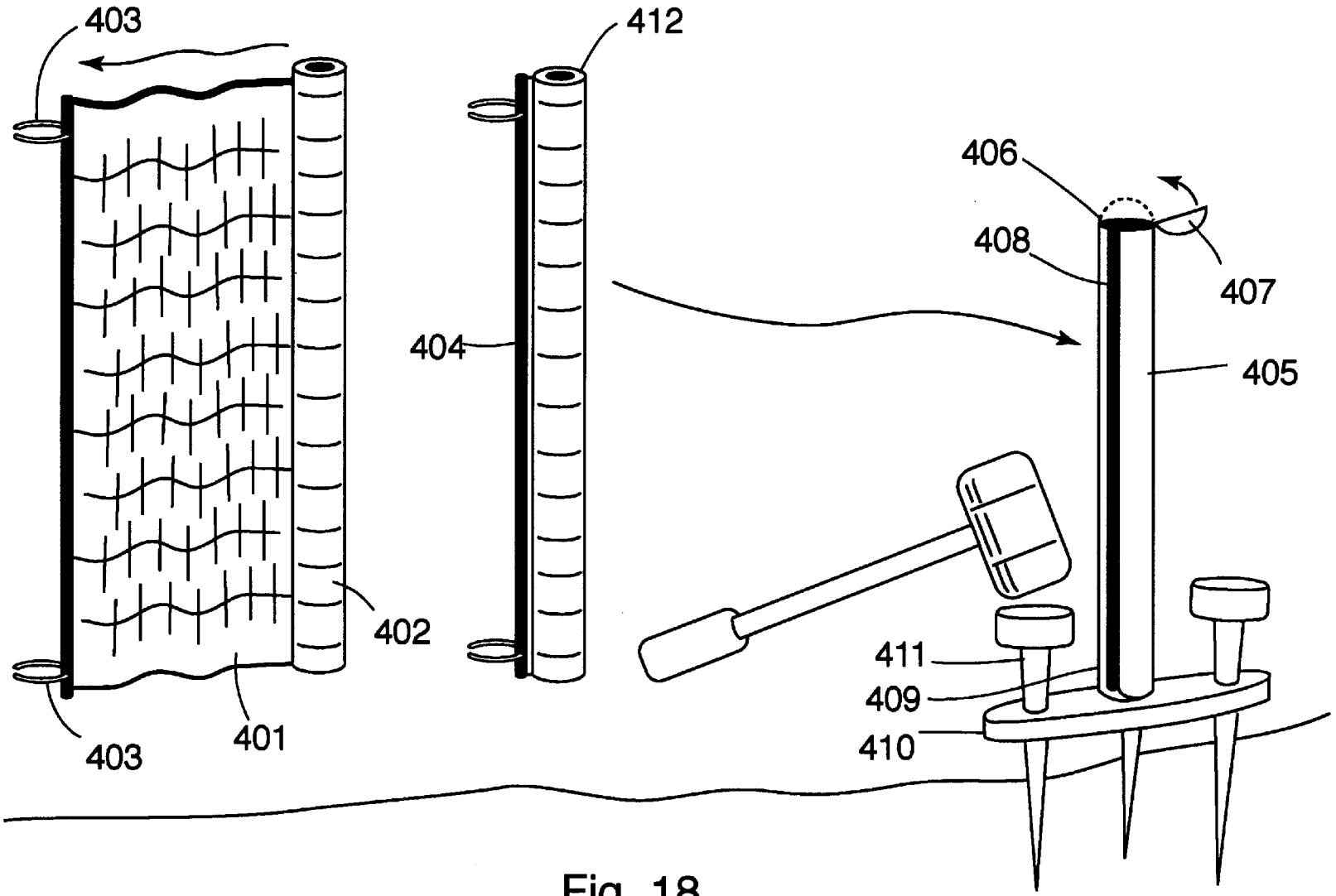
FIG. 18 is a perspective view of the fifth device of the present invention, showing the device being deployed in loose soil.
Figure 19:
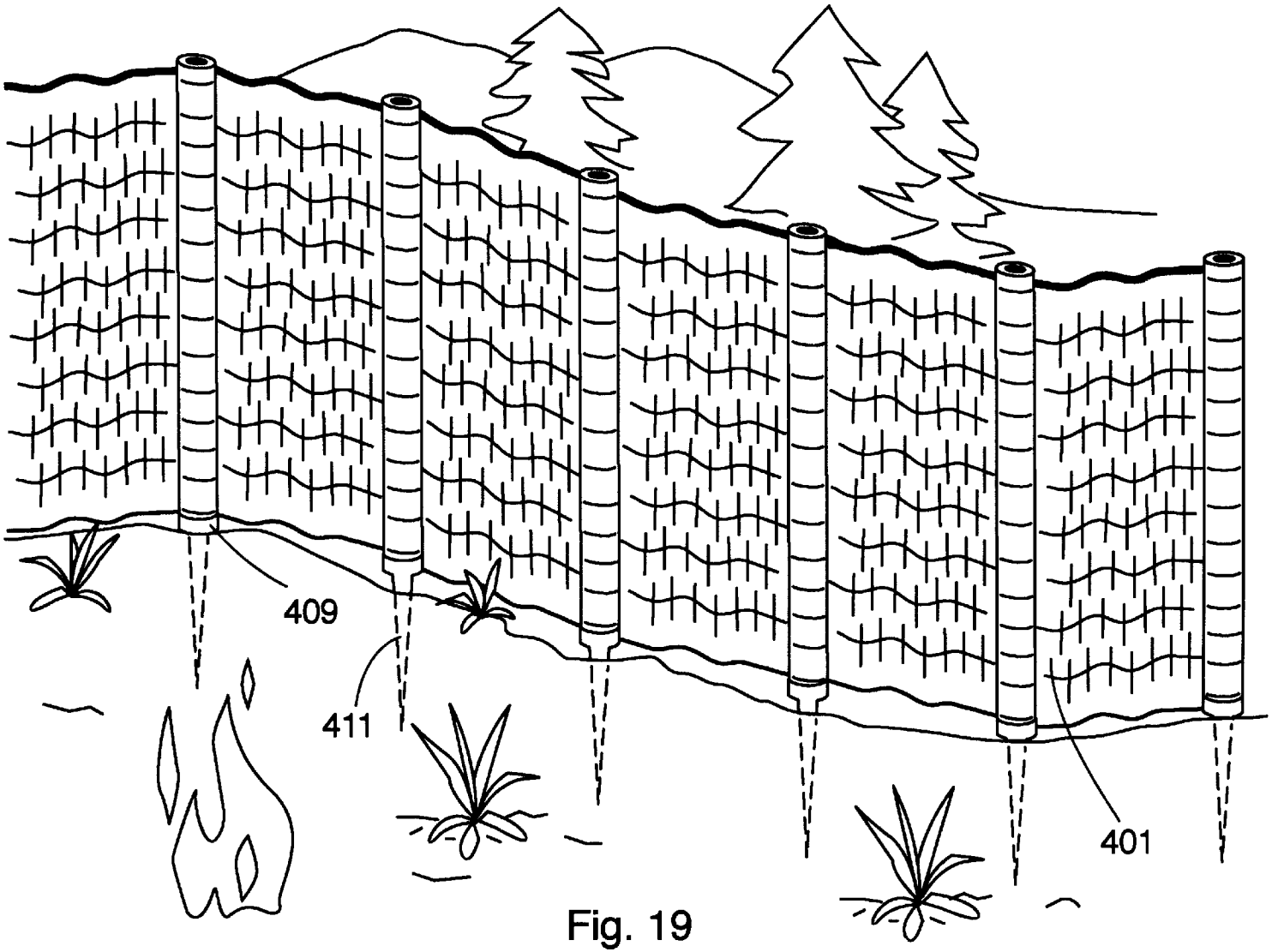
FIG. 19 is a perspective view of the fifth device of this invention deployed in terrain having loose soil.
Figure 20:
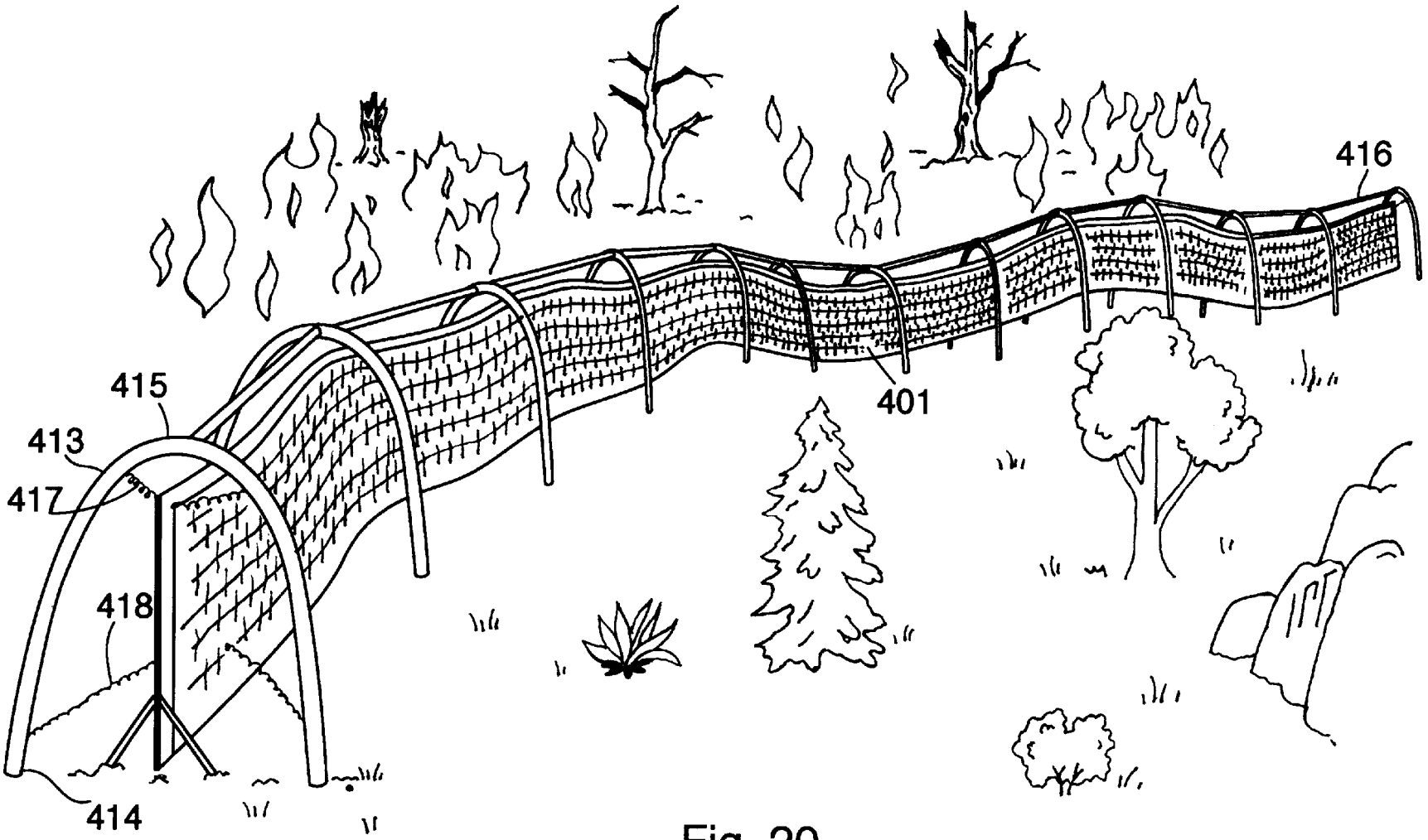
FIG. 20 is a perspective view of the fifth device of the present invention deployed in rocky terrain.

The invention will now be described with reference to the above drawing wherein like numerals refer to like features throughout.

The first device is a hollow structure 1 made of fire-resistant material. Ceramic, sheet metal, or thermosetting resins are examples of such materials. The device is made so as to be free-standing on solid ground. The device has a top 2, a bottom 3, a front 4, a back 5, and two sides 6. Viewed vertically, it may be seen as having a bottom portion, a central portion, and a top portion.

The back surface of the device (that surface of the device which will face away from the fire) is substantially vertical in its bottom and central portions. In its top portion, it curves upwardly and forwardly to meet with the top surface.

The top surface is arcuate in shape, sloping forwardly and upwardly. At the forward edge 7 of the top surface 2, there is preferably a deflector 8 which protrudes forwardly and upwardly. There is also present an attachment ring 9 which allows for attachment to a cable so that the device may be transported by helicopter.

The front surface 4 of the device (that surface of the device which will face toward the fire) contains at least one opening 10 leading to at least one horizontal intake duct 11. Preferably, there are two such intake ducts (a lower horizontal duct 11 and a central horizontal duct 12). Preferably, the top edge 13 of the lower horizontal duct 11 attaches to a deflector 14 which protrudes forwardly and upwardly. Each of the intake ducts 11 12 may preferably contain at least one baffle 15 serving to alter the path of the heat waves.

The horizontal intake ducts 11 12 lead to a vertical duct 16 which is situated along the back surface 5 of the device. The hot air entering the horizontal intake ducts 11 12 rises through the vertical duct 16 to be expelled from the device through the top opening 17 by way of the top duct 18. This expelled hot air meets with the heat wave of the fire and tends to slow the speed of the heat wave. The front surface 4 of the device also contains at least one, preferably two, openings 19 20 which lead to curved chambers 21 22. These curved chambers 21 22 preferably contain at least one baffle 23 serving to break up the flow of the heat wave and take energy out of the flow of the heat wave.

Thus, from bottom to top, the front surface 4 of a preferred device contains a first opening 10 to allow the intake of fire and heat into a lower horizontal duct 11, a second opening 19 which allows fire and heat into and out of a lower curved chamber 21, a third opening 24 to allow the intake of fire and heat into a central horizontal duct 12, a fourth opening 20 to allow fire and heat into and out of an upper curved chamber 22, and a fifth opening 17 which allows heat to escape forwardly out of the top duct 18.

As viewed from the front, a preferred device shows a hollow structure 1 which contains, from bottom to top, a lower horizontal duct 11 for the inlet of fire and heat into the hollow structure 1, a lower curved chamber 21, a central horizontal duct 12 for the intake of fire and heat into the hollow structure 1, an upper curved chamber 22, an upper horizontal duct 18 for the escape of heat forwardly out of the hollow structure, and a top deflector 8. There is also presented a vertical duct 16 leading from the bottom to the top along the back surface 5, which duct moves hot air from the lower and central horizontal intake ducts 11 12 to the upper horizontal duct 18.

In a preferred device, there is a container for water 25 near the back surface 5 of the device, a container for water 26 near the front surface 4 of the device, and a gently downwardly sloping duct 27 connecting the two containers. Water is poured into the rear container 25, flows through the duct 27 to enter the front container 26, and turns to steam when the fire approaches the device. This change of state absorbs heat. Also, the produced steam has a fire-repression activity.

The second device according to the present invention comprises an upstanding structure 101 made of fire-resistant material, such as ceramic, thermosetting resin, or sheet metal. The device has a top surface 102, a bottom surface 103, a front surface 104, a back surface 105, and two side surfaces 106. The top surface 102 has a forward curvature of from 10 to 45° in order to stop the progress of the fire and to turn the fire back upon itself An attachment ring 107 is affixed to the top surface 102 so as to allow the device to be attached to a line which is secured to a helicopter. This allows for ease of transportation from the truck to the perimeter. The front surface 104 of this device has an arcuate baffle 108 extending from the device about halfway between the bottom and the top of the device. This baffle 108 serves to break up the heat wave and disperse the air flow. This baffle 108 is broad at the base 109, extending across the entire width, or substantially the entire width, of the device. The forward (distal) edge 110 of the baffle 108 is somewhat narrower, having a width of only about one-third of the device, Thus, when the devices are aligned side by side, there are gaps between these baffles 108. This combination of space and baffle 108 serves to have a dispersing effect on the flow of the heat wave, and thereby causes the fire to dissipate. In order to give support to the device, the device has support legs 111 extending from the front 104 and rear 105 surfaces. These legs 111 extend distally and downwardly at an angle of about 45°. The bottom ends, or feet 112, may contain downwardly projecting protrusions 113 which sink into the ground when the device is dropped into place from a helicopter, thereby adding to the support of the device.

The bottom surface 103 preferably has at least one downward projection 114 which sinks into the ground when the device is dropped from a helicopter at an appropriate height. These projections 114 thus give added stabilization to the device. To give the device even more stability, both the front 104 and rear 105 surfaces contain attachments 115 thereto below the arcuate baffle 108. These attachments 115 connect to support lines 116 which are connected to the ground by support spikes 117.

The devices are designed to be aligned side by side by conventional means for this purpose so a to present a long solid barrier to a fire.

In addition to preventing the forward progress of a wildfire, the devices of this invention may be used to surround buildings so a to offer these buildings protection against oncoming fire. Additionally, these devices may be used in constructing temporary shelters for firefighters against approaching fires. In either of the above instances, it may be desirable to have a multiple-layer barrier so as to improve safety.

The third device of the present invention comprises an upstanding device 201 for standing upon solid ground. The device is composed of fire-resistant materials, preferably ceramic, thermosetting resin, or sheet metal.

The device has a bottom surface 202, a back surface 203 (that surface which faces away from the fire), a top surface 204, a front surface 205 (that surface which faces the fire), and two side surfaces 206.

The device is composed of a plurality of horizontal sections 207 208 209 preferably three. These sections 207 208 209 are hingedly connected 210 at their abutment lines 211.

The lower section 207 contains support means 212 on both the front 205 and back 203 surfaces. The support means 212 are preferably triangular legs 213 which, when not in use, fit into leg-shaped hollow areas 214 in the front 205 and back 203 surfaces of the device. The triangular legs 213 have a side parallel to the ground 215, a side perpendicular to the ground 216, and a hypotenuse 217. The support legs 213 are attached to the device along a side of the triangle, preferably the side perpendicular to the ground 216. The attachments are preferably hinges 218, allowing the support legs 213 to fold away from the device for stability and back to the device for ease of storage and transportation. These support means 212 allow for compact storage and ease of setting up a stable device.

To add to the stability, the device may contain downwardly projecting spikes 219 which will sink into solid ground when the device is dropped a short distance.

The most central section 208 contains a plurality of openings 220. Preferably, these openings 220 are located where the most central section 208 and the next lower section 207 join. These openings 220 accept inserts 221 located at the proximal edge 222 of the baffle 223, and serve to removably attach the baffle 223 to the rest of the device in a way that the baffle 223 can be quickly and easily inserted. The baffles 223 are arcuate in form, and slope upwardly and outwardly. Generally, they are the same width as the remainder of the device. Alternatively, baffles 223 may be provided which are shorter at their distal end 224 than their proximal end 222. This would allow for the construction of barriers which must curve inwardly.

The upper section 209 is arcuate in form, sloping upwardly and forwardly. This allows the device to break up the motion of the heat waves and to turn the fire back upon itself. The upper section 209 contains an attachment ring 225 for connecting with a line carried by a helicopter for ease of transporting the device to and from the predetermined perimeter of the fire.

The back surface 203 of each section is equipped with hasps or sockets 226 near the upper or lower edge thereof. When being put in place, rods 227 may be inserted into two adjacent sockets 226 in order to stabilize the device.

For added stability of a plurality of devices when used as a barrier, each side surface 206 contains a plurality of openings 228 or corresponding pins 229. This allows a device to be removably abutted to an adjacent device. Preferably, the openings 228 are larger than the pins 229 to allow for uneven terrain or curvature of the barrier.

The fourth device of the present invention comprises a sheet 301 of fire-resistant material, preferably containing asbestos fibers. Small sheets of such material are known and are used by welders for protection. Fire resistant synthetic fibers are also known, which are suitable for this purpose.

The sheet 301 of the fourth device contain a first end 302, a second end 303, two side edges 304, a top 305 and a bottom 306. The sheet 301 is of such a size so that, when folded, it may be conveniently transported by a large truck 307, such as large flat bed truck or an open-top tractor trailer. When unfolded, the sheet 301 of the present invention has a length of approximately 100 yards and a width of approximately 20 yards.

The sheets 301 of this invention may be transported from trucks 307 to the chosen perimeter by helicopter. To allow for this mode of transportation, one end of a sheet 301 has weights 308 to give stability in windy conditions and the other end contains at least one tow line 309 to allow for attachment to a helicopter.

When necessary, a plurality of the sheets 301 may be laid side by side in order to prevent wind from carrying fire across the resulting barrier.

To constrain crown forest fires, sheets 301 of this invention may be draped by helicopter over the upper parts of trees at the selected perimeter. To constrain brush fires, the sheets of the present invention may be laid end to end along the open ground or bushes at the chosen perimeter. One or more sheets 301 may be draped over a structure or personal property to protect it from the wildfire.

The fifth device of this invention comprises a sheet 401 of fire-resistant material. Preferred material is composed of 2 mil of aluminum bonded to glass cloth with fire resistant adhesive. In addition to being fire resistant, this material is light weight and flexible. These qualities are desirable for articles which must be manually transported and deployed in uneven terrain.

For storage, the sheets 401 are in the form of rolls 402 having the vertical dimension of the sheet 401. Clasps 403 are attached to the free end 404 of the sheet 401. These rolls 402 are stored in cylindrical containers 405. The containers 405 have an open top end 406 with a closeable and openable top 407 for easy insertion of the rolls 402. The containers have a lengthwise slit 408 for ease in unrolling the sheets 401 while they remain in the containers 405. Each container 405 has a bottom end 409 containing an expanded base 410 which may be affixed firmly to the ground by stakes 411. Alternatively, the bottom end 409 of the container 405 may contain a hole for the passage of a stake 411. For deployment, the free end 404 of one sheet 401 is pulled away from its container 405. Complete separation is avoided as the sheet 401 is firmly attached to a lightweight tubular hub 412 which has a diameter greater than the width of the slit 408. The clasps 403 at the top and bottom of the free end 404 slip around and firmly grasp an adjoining container 405. This process is continued until a wall of the desired length is deployed.

A second aspect of the fifth device is more suited for rocky, uneven terrain. The sheets 401 may be attached as described above or in conventional methods, such as hook-and-eye connectors, clasps, and other known ways of connecting sheets. Tubular arches 413 containing two bottom ends 414 and one apex 415 are deployed along the established perimeter. Suitable anchoring devices are employed to maintain the arches 413 in an erect position. Lines 416 attached to the apices 415 of the arches 413 help to maintain the arches upright and capable of supporting a wall of sheets 401. The sheets 401 are maintained in the vertical position by lines 417 418 between the sheets 401 and the arches 413.

The type of ground cover, terrain, and type of fire will be determining factors in deciding which devices to use in a given instance. It is clear that in a given wildfire, more than one type of device may be used, and this invention contemplates instances where a plurality of devices or all five devices would be used in constraining a single fire.

In operation, the users of the above devices will determine a likely perimeter to be established. The devices are brought to a site near the perimeter by truck. If necessary, the devices can then be transported by helicopter to the preselected perimeter. The devices are aligned side by side to form a fire barrier at the perimeter. Following the construction of the barrier wall, backfires may be used between the wall and the fire as backfires would be less likely to penetrate the wall and these fires would consume the fuel otherwise used by the wildfire. Following the threat of the wildfire, the barrier may be disassembled, and the device may be stored until needed again.

Various modes of carrying out the invention are contemplated as being within the scope of the following claims.

I claim:

1. A device for constraining wildfires, comprising a fire-resistant structure having a top surface, a bottom surface, a front surface, a back surface, and two side surfaces, wherein: the top surface has a forward curvature; the front surface has an arcuate baffle having a base removably attached about halfway between the top and bottom of the device; both the front and rear surfaces have support legs foldably attached thereto; and the device is hingedly foldable horizontally to create a plurality of horizontal sections for convenience in storage and transportation.

2. A structure for constraining wild fires, comprising a plurality of the devices of claim 1 attached side-to-side.

3. A method of constraining a wild fire, which comprises aligning a plurality of the devices of claim 1 side-by-side along a predetermined perimeter of the fire so as to form a barrier.

* * * * *